US006237150B1

(12) United States Patent
Lucas

(10) Patent No.: US 6,237,150 B1
(45) Date of Patent: May 29, 2001

(54) DISPOSABLE BIB

(76) Inventor: Rick J. Lucas, 63 George Marshall Way, Winnipeg, Manitoba R2C 5B9 (CA)

( * ) Notice: Subject to any disclaimer, the term of this patent is extended or adjusted under 35 U.S.C. 154(b) by 0 days.

(21) Appl. No.: 09/616,980

(22) Filed: Jul. 14, 2000

(51) Int. Cl.[7] ..... A41D 27/00
(52) U.S. Cl. ..... 2/49.1; 2/49.4
(58) Field of Search ..... 2/49.1–49.5, 48, 2/50, 51

(56) References Cited

U.S. PATENT DOCUMENTS 797,434 * 8/1905 Homeyer ..... 2/49.1
3,979,776 * 9/1976 Gruenwald ..... 2/49.1
3,995,321 * 12/1976 Johnson ..... 2/49.5
4,646,365 * 3/1987 Suprise et al. ..... 2/49.2
4,797,952 * 1/1989 Petrini ..... 2/49.2
4,811,428 * 3/1989 Waldman et al. ..... 2/49.3
5,201,073 * 4/1993 Spanier ..... 2/49.2
5,802,610 * 9/1998 Burr ..... 2/49.4

* cited by examiner

*Primary Examiner*—Gloria M. Hale

(57) ABSTRACT

A disposable bib for catching food and liquids while feeding an infant or toddler. The disposable bib includes a panel. The panel has a bottom edge, a top edge, and a pair of side edges. The panel has a top layer, a middle layer and a bottom layer. The top layer comprises a relatively porous material, the middle layer comprises a relatively absorbent material, and the bottom layer comprises a relatively non-porous material. The panel has an opening therein positioned generally adjacent to the top edge.

6 Claims, 5 Drawing Sheets

DISPOSABLE BIB

BACKGROUND OF THE INVENTION

1. Field of the Invention

The present invention relates to bibs and more particularly pertains to a new disposable bib for catching food and liquids while feeding an infant or toddler.

2. Description of the Prior Art

The use of bibs is known in the prior art. More specifically, bibs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,811,428; U.S. Pat. No. 4,780,911; U.S. Pat. No. 4,622,698; U.S. Pat. No. 5,802,610; U.S. Pat. No. Des.341,472; and U.S. Pat. No. 4,706,3 03.

While these devices fulfill their respective, particular objectives and requirements, the aforementioned patents do not disclose a new disposable bib. The inventive device includes a panel. The panel has a bottom edge, a top edge, and a pair of side edges. The panel has a top layer, a middle layer and a bottom layer. The top layer comprises a relatively porous material, the middle layer comprises a relatively absorbent material, and the bottom layer comprises a relatively non-porous material. The panel has an opening therein positioned generally adjacent to the top edge.

In these respects, the disposable bib according to the present invention substantially departs from the conventional concepts and designs of the prior art, and in so doing provides an apparatus primarily developed for the purpose of catching food and liquids while feeding an infant or toddler.

SUMMARY OF THE INVENTION

In view of the foregoing disadvantages inherent in the known types of bibs now present in the prior art, the present invention provides a new disposable bib construction wherein the same can be utilized for catching food and liquids while feeding an infant or toddler.

The general purpose of the present invention, which will be described subsequently in greater detail, is to provide a new disposable bib apparatus and method which has many of the advantages of the bibs mentioned heretofore and many novel features that result in a new disposable bib which is not anticipated, rendered obvious, suggested, or even implied by any of the prior art bibs, either alone or in any combination thereof.

To attain this, the present invention generally comprises a panel. The panel has a bottom edge, a top edge, and a pair of side edges. The panel has a top layer, a middle layer and a bottom layer. The top layer comprises a relatively porous material, the middle layer comprises a relatively absorbent material, and the bottom layer comprises a relatively non-porous material. The panel has an opening therein positioned generally adjacent to the top edge.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new disposable bib apparatus and method which has many of the advantages of the bibs mentioned heretofore and many novel features that result in a new disposable bib which is not anticipated, rendered obvious, suggested, or even implied by any of the prior art bibs, either alone or in any combination thereof.

It is another object of the present invention to provide a new disposable bib which may be easily and efficiently manufactured and marketed.

It is a further object of the present invention to provide a new disposable bib which is of a durable and reliable construction.

An even further object of the present invention is to provide a new disposable bib which is susceptible of a low cost of manufacture with regard to both materials and labor, and which accordingly is then susceptible of low prices of sale to the consuming public, thereby making such disposable bib economically available to the buying public.

Still yet another object of the present invention is to provide a new disposable bib which provides in the apparatuses and methods of the prior art some of the advantages thereof, while simultaneously overcoming some of the disadvantages normally associated therewith.

Still another object of the present invention is to provide a new disposable bib for catching food and liquids while feeding an infant or toddler.

Yet another object of the present invention is to provide a new disposable bib which includes a panel. The panel has a bottom edge, a top edge, and a pair of side edges. The panel has a top layer, a middle layer and a bottom layer. The top layer comprises a relatively porous material, the middle layer comprises a relatively absorbent material, and the bottom layer comprises a relatively non-porous material. The panel has an opening therein positioned generally adjacent to the top edge.

Still yet another object of the present invention is to provide a new disposable bib that is made from absorbent material having a non-porous backing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
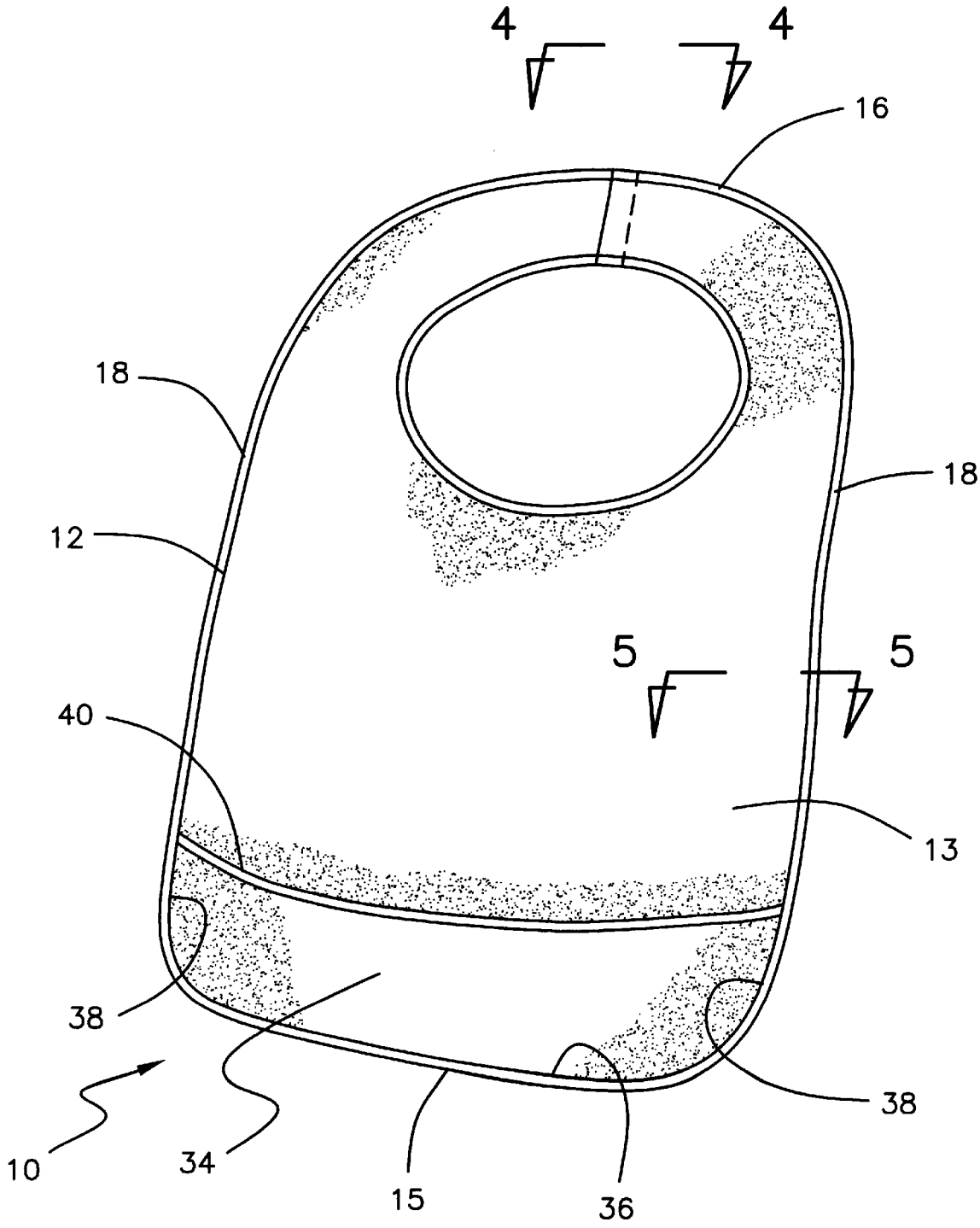
FIG. 1 is a schematic perspective view of a new disposable bib according to the present invention.
Figure 2:
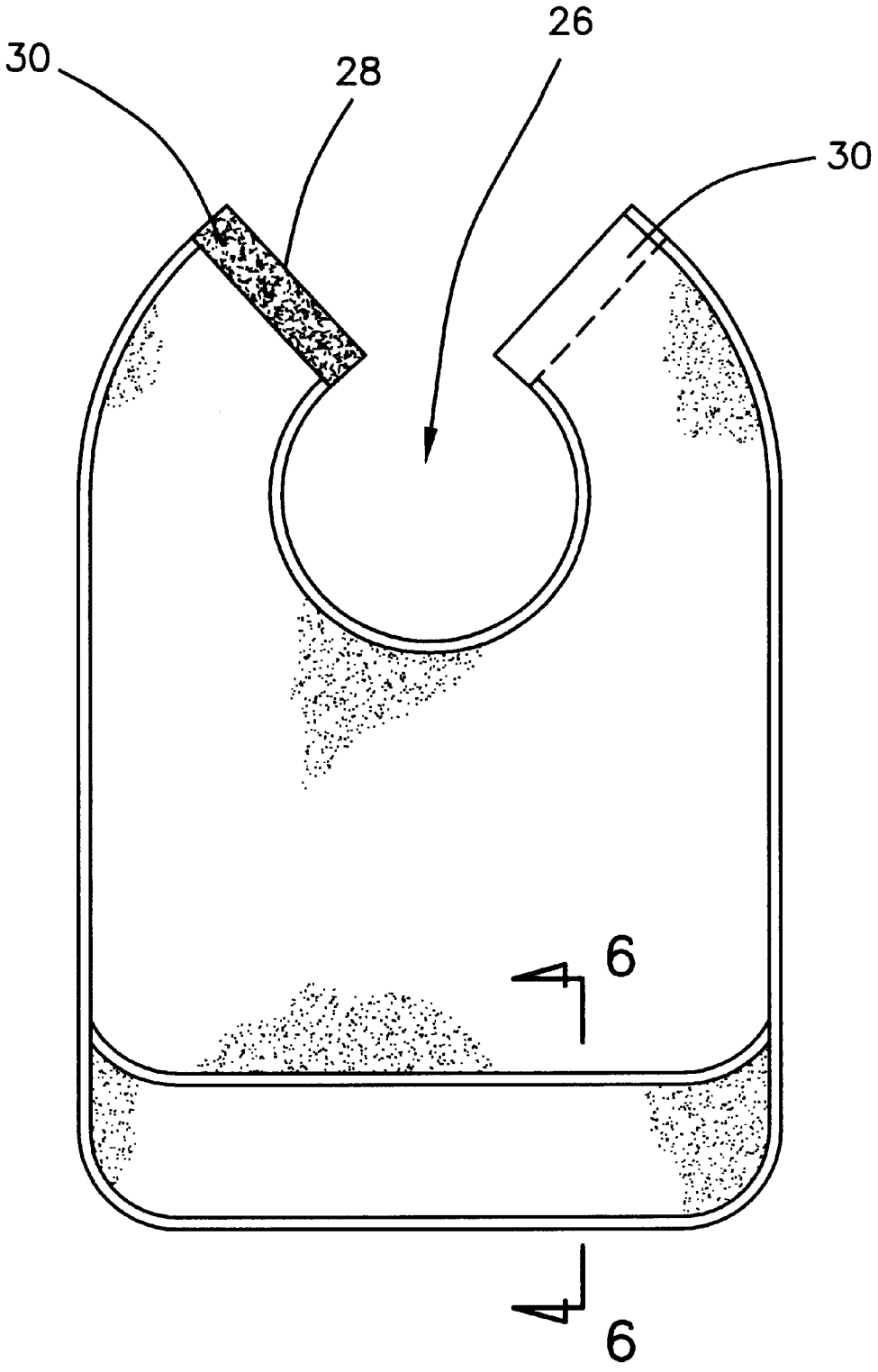
FIG. 2 is a schematic plan view of the present invention.

With reference now to the drawings, and in particular to FIGS. 1 through 6 thereof, a new disposable bib embodying the principles and concepts of the present invention and generally designated by the reference numeral 10 will be described.

As best illustrated in FIGS. 1 through 6, the disposable bib 10 generally comprises a panel 12. The panel 12 has a front side 13, a back side 14, a bottom edge 15, a top edge 16, and a pair of side edges 18. The panel 12 has a top layer 20, a middle layer 22 and a bottom layer 24. The top layer 20 comprises a relatively porous material. The top layer 20 is preferably a quilted paper. The middle layer 22 comprises a relatively absorbent material and is preferably a fiber fill material. The bottom layer 24 comprises a relatively non-porous material and is preferably a plastic. The panel 12 has an opening 26 therein. The opening 26 is positioned generally adjacent to the top edge 16. A slit 28 in the panel 12 extends from the top edge 16 into the opening 26 such that a pair of flaps 30 is defined. The panel 12 is preferably 6 to 10 inches long and 6 to 10 inches wide.

A securing means 32 removably secures the flaps 30 together. The securing means 32 preferably comprises a conventional hook and loop securing means.

A pocket member 34 comprises a sheet coupled to the front side 13 of the panel 12. The sheet 34 has a bottom edge 36 coupled to the bottom edge 15 of the panel 12 and a pair of side edges 38 coupled to the side edges 18 of the panel 12. A width of the sheet is preferably longer than a width of the panel such that a top edge 40 of the sheet bows outwardly away from the panel 12. The sheet comprises generally the same material as the panel.

Figure 3:
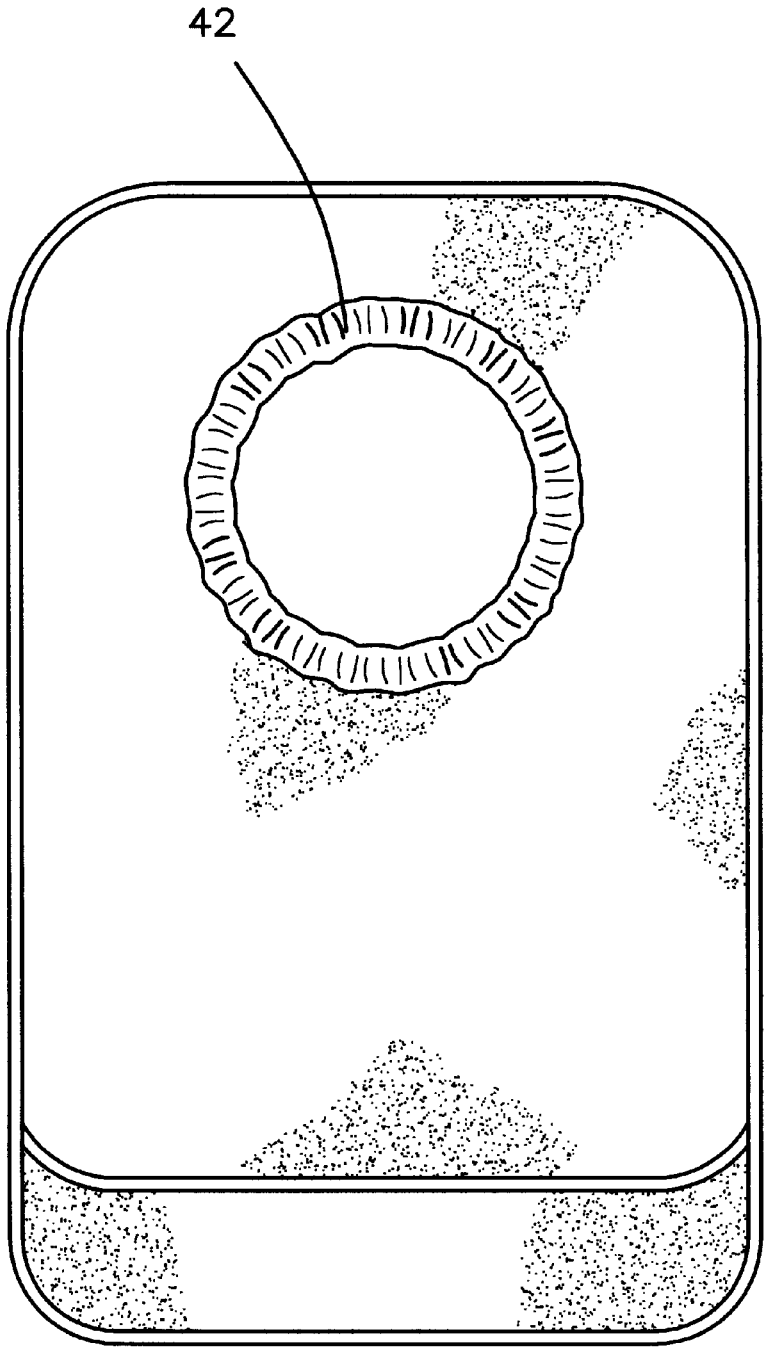
FIG. 3 is a schematic plan view of the second embodiment of the present invention.
Figure 4:
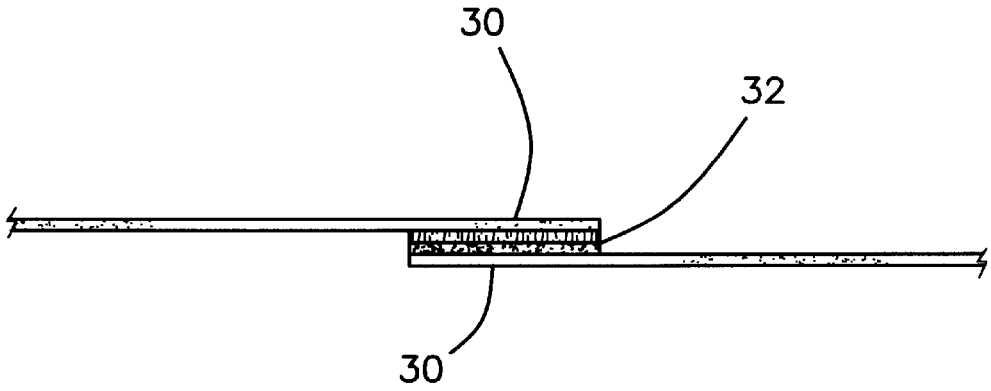
FIG. 4 is a schematic end view of the present invention.
Figure 5:
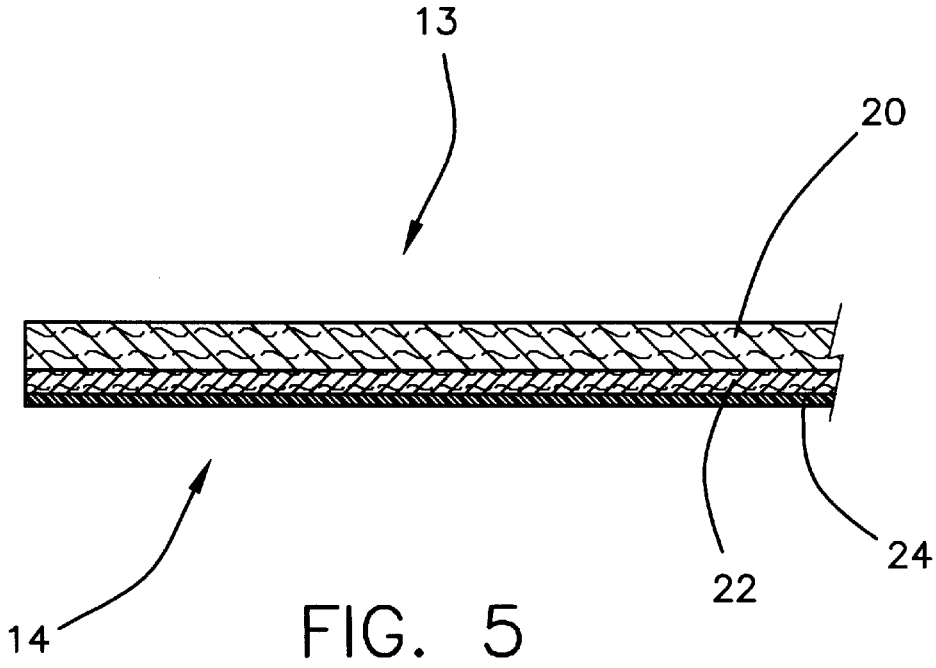
FIG. 5 is a schematic cross-sectional view taken along line 5—5 of the present invention.
Figure 6:
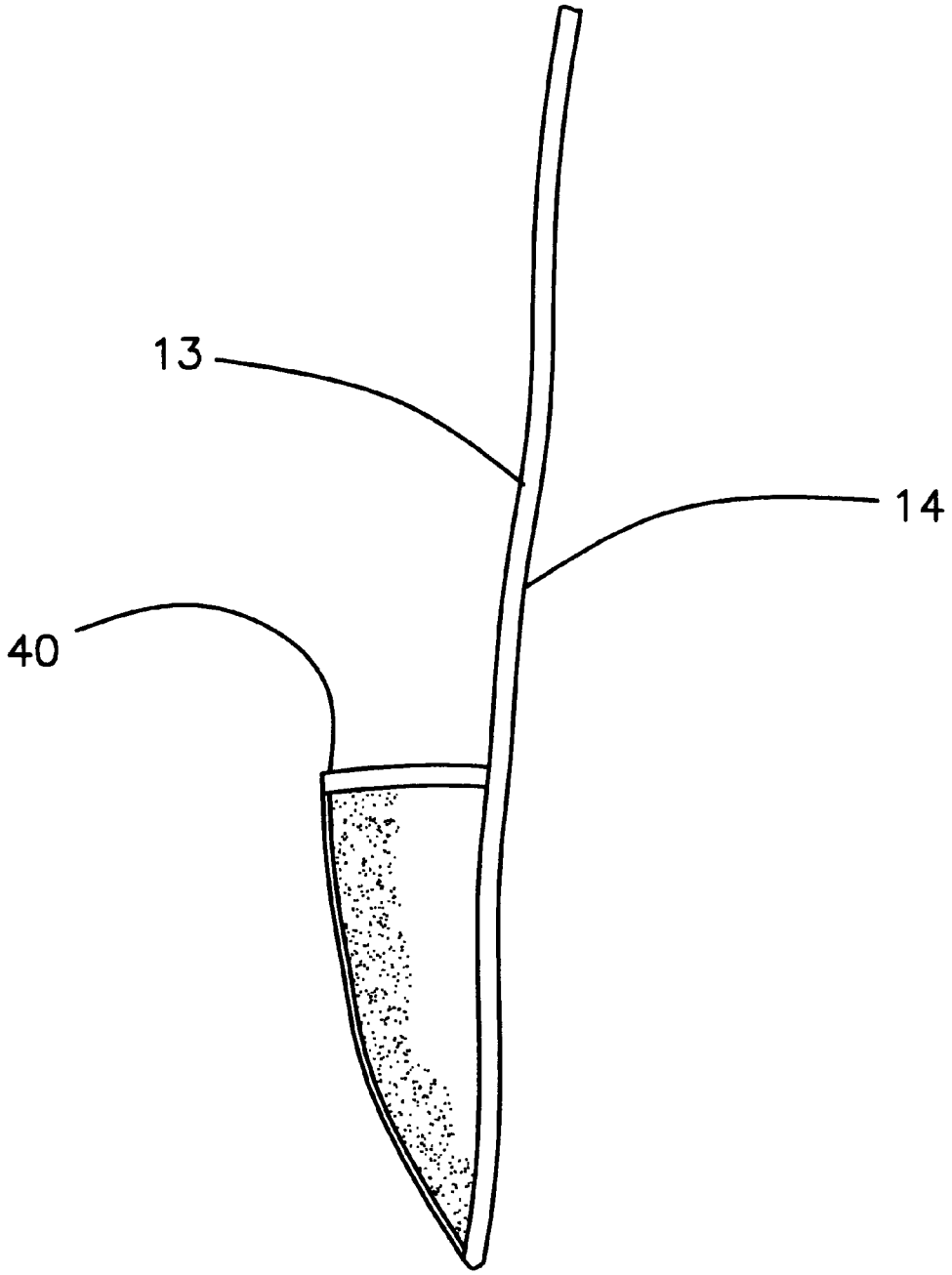
FIG. 6 is a schematic cross-sectional view taken along line 6—6 of the present invention.

The second embodiment, shown in FIG. 3, has an opening 26 but no slit 28 extending thereto. The opening 26 preferably has an edge having an elastic skirt 42 coupled thereto.

In use, the device is used as a conventional bib. The pocket member 34 catches any crumbs or other materials lost. The bib is thrown away after use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A disposable bib device, said device comprising:

a panel having a front side, back side, bottom edge, a top edge, and a pair of side edges, said panel having a top layer, a middle layer and a bottom layer, said top layer comprising a relatively porous material, said middle layer comprising a relatively absorbent material, said bottom layer comprising a relatively non-porous material, said panel having a neck opening for receiving the neck of a wearer while being worn by the wearer, said neck opening defined by an opening edge and being positioned generally adjacent to said top edge;

wherein a channel extends through said panel from said neck opening to said top edge for passing the neck of a wearer through said channel when putting on and removing said panel from the neck of a wearer, said channel being defined by a pair of opposed edges, each of said opposed edges extending radially from said neck opening to said top edge, said opposed edges being oriented on said panel with a first one of said opposed edges being positioned at an angle with respect to a second one of said opposed edges when said panel is laid flat such that bringing said opposed edges together tends to form an upper portion of said panel a substantially frusta-conical shape tapering narrower toward said neck opening.

2. The disposable bib device of claim 1 wherein the angle between said opposed edges of said channel is approximately 90 degrees.

3. The disposable bib device of claim 1 additionally comprising a pocket member coupled to said front side of said panel for catching debris falling from a wearer's mouth.

4. A disposable bib device, said device comprising:

a panel, said panel having a front side, back side, bottom edge, a top edge, and a pair of side edges, said panel having a top layer, a middle layer and a bottom layer, said top layer comprising a relatively porous material, said middle layer comprising a relatively absorbent material, said bottom layer comprising a relatively non-porous material, said panel having an opening therein, said opening defined by an opening edge and being positioned generally adjacent to said top edge;

a pocket member coupled to said front side of said panel for catching debris falling from a wearer's mouth;

an elastic skirting mounted on and extending along said opening edge for constricting said opening edge about the neck of a wearer; and an edging mounted on and extending along a perimeter of said panel and securing said top layer, said middle layer and said bottom layer together;

wherein said edging and said panel are adapted to lie substantially flat when said panel is not being worn by a wearer and said opening edge is fully constricted by said elastic skirting.

5. The disposable bib device as in claim 4, wherein said panel has a slit therein panel extending from said top edge into said opening such that a pair of flaps are defined; and a securing means removably secures said flaps together.

6. A disposable bib device, said device comprising:

a panel, said panel having a front side, a back side, a bottom edge, a top edge, and a pair of side edges, said panel having a top layer, a middle layer and a bottom layer, said top layer comprising a relatively porous material, said middle layer comprising a relatively absorbent material, said bottom layer comprising a relatively non-porous material, said panel having an opening therein, said opening being positioned generally adjacent to said top edge, a slit in said panel extending from said top edge into said opening such that a pair of flaps are defined;

a securing means removably secures said flaps together, said securing means comprising a hook and loop securing means;

a pocket member, said pocket member comprising a sheet coupled to said front side of said panel, said sheet having a bottom edge coupled to said bottom edge of said panel and a pair of side edges being coupled to said side edges of said panel, a width of said sheet being longer than a width of said panel such that a top edge of said sheet bows outwardly away from said panel, said sheet comprising generally the same material as said panel; and wherein a channel extends through said panel from said neck opening to said top edge for passing the neck of a wearer through said channel when putting on and removing said panel from the neck of a wearer, said channel being defined by a pair of opposed edges, each of said opposed edges extending radially from said neck opening to said top edge, said opposed edges being oriented on said panel with a first one of said opposed edges being positioned at an angle with respect to a second one of said opposed edges when said panel is laid flat such that bringing said opposed edges together tends to form an upper portion of said panel a substantially frusta-conical shape tapering narrower toward said neck opening.

* * * * *